United States Patent [19]

Toyofuku et al.

[11] Patent Number: 4,879,195

[45] Date of Patent: Nov. 7, 1989

[54] LASER-SENSITIVE ELECTROPHOTOGRAPHIC MATERIAL

[75] Inventors: Kunitaka Toyofuku, Sakura; Hiroaki Sato, Yonago; Kohei Michikawa, Yokohama, all of Japan

[73] Assignee: Oji Paper Co., Ltd., Tokyo, Japan

[21] Appl. No.: 285,556

[22] Filed: Dec. 16, 1988

[30] Foreign Application Priority Data

Dec. 18, 1987 [JP] Japan ..... 62-318933

[51] Int. Cl.[4] ..... G03G 5/09

[52] U.S. Cl. ..... 430/89; 430/92; 430/93

[58] Field of Search ..... 430/89, 92, 93

[56] References Cited

U.S. PATENT DOCUMENTS 3,197,307 7/1965 Blake et al. ..... 430/89
3,619,154 11/1971 Cavagna et al. .
3,682,630 8/1972 Park .

FOREIGN PATENT DOCUMENTS 58-59453 4/1983 Japan ..... 430/89

OTHER PUBLICATIONS

"Some Aspects of Spectral Sensitization of Zinc Oxide with Cyanine Dyes", Tappi, Sep. 1973, vol. 56, No. 9, pp. 101–104.

*Primary Examiner*—Roland E. Martin
*Attorney, Agent, or Firm*—Armstrong, Nikaido, Marmelstein, Kubovcik & Murray

[57] ABSTRACT

An electrophotographic material having an enhanced sensitivity to laser rays comprises, (A) an electroconductive substrate, and (B) a laser-sensitive electrophotographic layer comprising (a) a finely divided photoconductive zinc oxide, (b) a resinous binder, (c) a sensitizing coloring material comprising at least one member selected from the compounds of the formulae (I) and (II):

(I)

and

-continued (II)

in which $m^1$, $m^2$, $n^1$ and $n^2$ are 1 to 8, $R^1$ and $R^2$ are —COO or —$SO_3$, $R^3$ and $R^4$ are H, —CH=$CH_2$ —COOH, —$SO_3H$, —COONa, —$SO_3Na$, COOK or —$SO_3K$, X is Cl, Br, I or —$ClO_4$, and (Abstract continued on next page.)

-continued
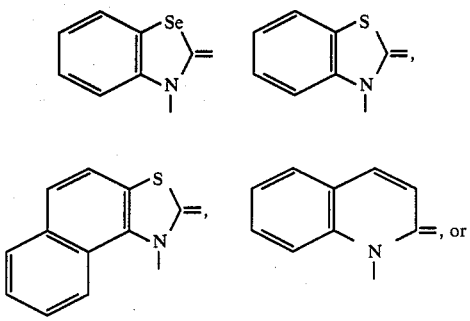
-continued
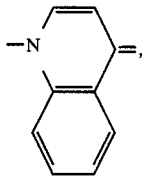
and, (d) a sensitizing assistant comprising at least one carboxylic anhydride of the formula (III):
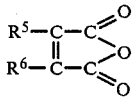
(III)
wherein $R^5$ and $R^6$ are H, $C_{1-8}$ alkyl or phenyl.
7 Claims, No Drawings

LASER-SENSITIVE ELECTROPHOTOGRAPHIC MATERIAL

BACKGROUND OF THE INVENTION

1. Field of the Invention

The present invention relates to a lasersensitive electrophotographic material. More particularly, the present invention relates to an electrophotographic material having an enhanced spectral sensitivity to semiconductor laser rays; i.e., over the spectrum of from red light rays to infra-red rays.

2. Description of the Related Art

Generally, a conventional zinc oxide-resin dispersion type electrophotographic material comprises an electroconductive substrate and a photosensitive layer formed on a surface of the substrate and comprises a principal component consisting of a finely divided photoconductive zinc oxide and an additional material consisting of a resinous binder and a sensitizing agent.

The zinc oxide contained in the photosensitive layer exhibits photosensitivity only at a wave length of about 370 nm located in the ultraviolet band. Therefore, in the conventional electrophotographic material sensitive to visible light rays, the zinc oxide must be presented in combination with a sensitizing coloring material in the photosensitive layer, to broaden the wave length range of light rays to which the photosensitive layer exhibits a satisfactory sensitivity.

Usually, the visible light rays are used as a photographic light for the electrophotographic material. Due to the development of various recording machines such as laser printers, however, various laser rays, for example, argon laser rays, and helium-neon laser rays, are now widely used for the electrophotographic materials. Where laser rays in the visible light band are used, it is known that the zinc oxide in the photosensitive layer is used as a photoconductive material in combination with a sensitizing coloring material, for example, Rose Bengale, Erythrosin, or Bromophenol Blue.

Now, however, semiconductor laser rays, which are in a visible or near infra-red ray band and have a large wave length of 700 to 1000 nm, are used instead of the conventional laser rays, since these semiconductor laser rays can be generated at a lower cost than that of the conventional laser rays, and can be directly modulated and used in a smaller device than that needed for the conventional laser rays.

The conventional photosensitive laser containing the zinc oxide in combination with the sensitizing coloring material exhibits a very low or substantially no sensitivity to the semiconductor laser rays, and thus the conventional electrophotographic material is substantially useless for use with the semiconductor laser rays.

Various electrophotographic materials having an enhanced sensitivity to the semiconductor laser rays are disclosed in, for example, Japanese Unexamined Patent Publication Nos. 57-46245, 58-58554, 58-59453, 59-22053, 59-78358, and 60-26949.

In those electrophotographic materials, the finely divided zinc oxide is contained in combination with a sensitizing coloring material, for example, a polymethine type cyanine dye, to extend the spectral wave length range of the usable light rays to which the electrophotographic materials are sensitive, to the long wave length side.

However, this type of conventional electrophotographic material in which zinc oxide is contained in combination with only the sensitizing coloring material, is disadvantageous in that the resultant photosensitive layer exhibits an unsatisfactory sensitivity to the semiconductor laser rays. Especially, in recording machines, for example, a laser printer, the scanning exposure is carried out at a high speed, and thus the conventional electrophotographic material containing the sensitizing coloring material is not satisfactory or practical for semiconductor laser ray exposure.

Some of the conventional electrophotographic materials sensitive to the semiconductor laser rays contain, in addition to the sensitizing coloring material, a sensitizing assistant consisting of an electron-affinitive compound, for example, benzoquinone, chloranil, phthalic anhydride, dinitrobenzoic acid or tetracyanoquinodimethane. This type of conventional electrophotographic material is disadvantageous in that the absorption of the sensitizing assistant compound on the surface of the zinc oxide particle is poor, and thus the sensitizing effect of the assistant is unsatisfactory. Further, some of the assistant compounds cause the electric resistance of the electrosensitive layer in a darkroom to be excessively decreased.

SUMMARY OF THE INVENTION

An object of the present invention is to provide a laser-sensitive electrophotographic material having an excellent sensitivity to long wave length rays having a wave length of from 700 to 1000 nm.

Another object of the present invention is to provide a laser-sensitive electrophotographic material having a high sensitivity to semiconductor laser rays.

The above-mentioned objects are attained by the laser-sensitive electrophotographic material of the present invention, which comprises (A) an electroconductive substrate; and (B) a laser-sensitive electrophotographic layer formed on a surface of the substrate and comprising a finely divided photoconductive zinc oxide, a resinous binder, a sensitizing coloring material and a sensitizing assistant, said sensitizing coloring material comprising at least one member selected from the group consisting of compounds of the formulae (I) and (II):

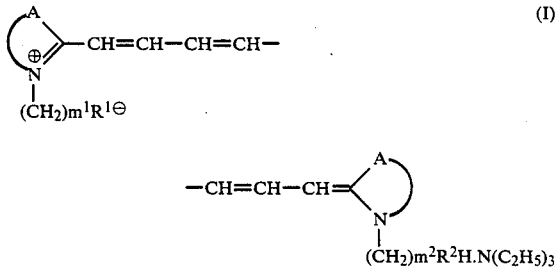

(I)

and

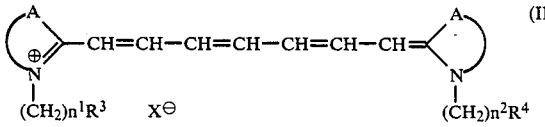

(II)

in which formulae $m^1$ and $m^2$ represent respectively and independently from each other, an integer of 1 to 8, $R^1$ and $R^2$ represent respectively and independently from each other, a member selected from the group consisting of —COO and —$SO_3$ radicals, $n^1$ and $n^2$ represent respectively and independently from each other, an integer of 1 to 8, $R^3$ and $R^4$ represent respectively and independently from each other, a member selected from the group consisting of a hydrogen atom and —CH=$CH_2$ , —COOH, —$SO_3H$, —COONa, —$SO_3Na$, —COOK and —$SO_3K$ radicals, X represents a member selected from the group consisting of chroline, bromine and iodine atoms and —$C10_4$ radical, the terminal group of the formula

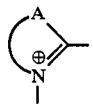

is selected from the group consisting of

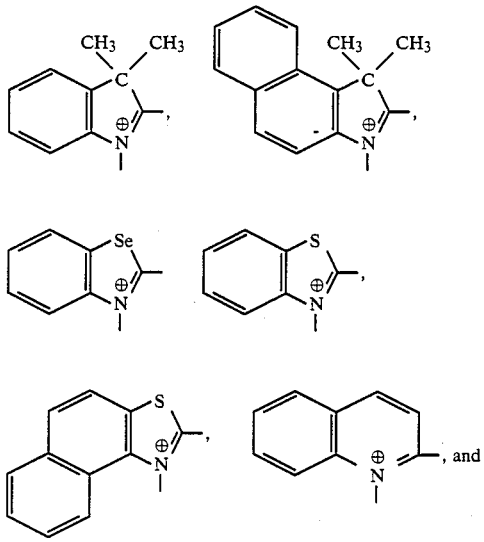

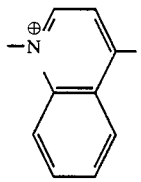

and the terminal group of the formula

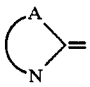

is selected from the group consisting of

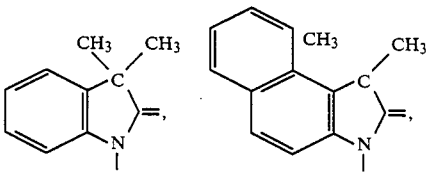

-continued

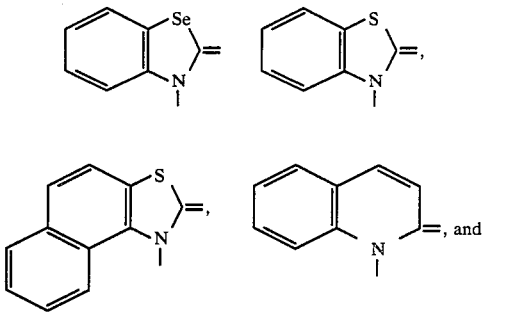

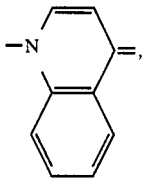

and the sensitizing assistant comprising at least one carboxylic anhydride of the formula (III):

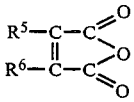

(III)

wherein $R^5$ and $R^6$ represent respectively and independently from each other, a member selected from the group consisting of a hydrogen atom and substituted and unsubstituted alkyl radicals having 1 to 8 carbon atoms and phenyl radical.

DESCRIPTION OF THE PREFERRED EMBODIMENTS

The laser-sensitive electrophotographic material of the present invention comprises, (A) an electroconductive substrate and (B) a laser-sensitive electrophotographic layer formed on a surface of the substrate.

The electroconductive substrate usable for the present invention comprises a member selected from, for example, metal plates, paper, and plastic resin sheets coated with a metallic material or a metal oxide material by a vacuum evaporation method, metal foils, for example, aluminum foil, laminates of a paper sheet with a plastic resin film, and electroconductive paper sheets.

The laser-sensitive elecrophotographic layer comprises a finely divided photoconductive zinc oxide, a resinous binder, a sensitizing coloring material, and a sensitizing assistant.

The sensitizing coloring material usable for the electrophotographic layer of the present invention comprises at least one member selected from the compounds of the above-mentioned formulae (I) and (II).

The specific compounds of the formula (I) wherein $m^1$ and $m^2$ are respectively 1 and $R^1$ and $R^2$ are respectively a —COO radical; $m^1$ and $m^2$ are respectively 2 and $R^1$ and $R^2$ are respectively a —$SO_3$ radical; $R^1$ and $R^2$ are respectively 3 and $R^1$ and $R^2$ are respectively a —COO radical; or $m^1$ and $m^2$ are respectively 2 and $R^1$ and $R^2$ are respectively a —COO radical, are preferable as sensitizing coloring materials for the present invention.

Also, the specific compound of the formula (II) wherein $n^1$ and $n^2$ are respectively 1, $R^3$ and $R^4$ are respectively a hydrogen atom and X is a bromine (Br) atom; $n^1$ and $n^2$ are respectively 2, $R^3$ and $R^4$ are respectively a —COONa radical and X is an iodine atom; or $n^1$ and $n^2$ are respectively 3, $R^3$ and $R^4$ are respectively a $—SO_3Na$ radical and X is an iodine atom, are preferable as sensitizing coloring materials for the present invention.

The sensitizing coloring material in the electrophotographic layer is preferably in an amount of from 0.001% to 0.5%, more preferably from 0.01% to 0.2%, based on the weight of the zinc oxide.

In the electrophotographic material of the present invention, the sensitizing assistant to be contained in the electrophotographic layer comprises at least one carboxylic anhydride of the above-mentioned formula (III) in an amount of 0.01% to 1% based on the weight of the zinc oxide.

The carboxylic anhydrides of the formula (III) include maleic anhydride and derivatives thereof.

It is known from the prior arts that the electron-affinitive organic compounds, for example, benzoquinone, chloranil, phthalic anhydride, dinitrobenzoic acid, and tetracyanoquinoquinodimethane are useful as a sensitizing assistant for the zinc oxide type electrophotographic materials. Nevertheless, those compounds are disadvantageous in that they have a poor absorbing property to the zinc oxide particle surface and an unsatisfactory electron-attracting property, and thus the sensitizing effect of the compounds is poor. The compounds are further disadvantageous in that they cause the electric resistance of the electrophotographic layer in a darkroom to be decreased.

The sensitizing assistant comprising maleic anhydride or derivatives thereof of the formula (III) has a high absorbing property on the zinc oxide particle surface, and thus exhibits an excellent sensitizing effect for the electrophotographic layer. Further, the compounds of the formula (III) substantially do not cause the reduction of the electric resistance of electophotographic layer in a darkroom.

The effect of the sensitizing assistant of the present invention is particularly enhanced when used in combination with the specific sensitizing coloring material of the present invention, comprising the polymethine type cyanine dyes of the formulae (I) and (II). This specific phenomenon was discovered for the first time by the inventors of the present invention.

The carboxylic anhydrides of the formula (III) wherein $R^5$ and $R^6$ are respectively a hydrogen atom; $R^5$ is a hydrogen atom and $R^6$ is a $—CH_3$ radical; $R^5$ is a hydrogen atom and $R^6$ is a

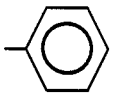

radical; or $R^5$ and $R^6$ are respectively a hydrogen atom, are preferable as the sensitizing assistant of the present invention.

The zinc oxide usable for the electrophotographic layer of the present invention has a photoconductive property and is in the form of fine particles preferably having a particle size of from 0.1 to 0.5 μm.

The resinous binder usable for the electrophotographic layer of the present invention comprises at least one type of resinous binding material. The resinous binding materials usable for the present invention are not limited to special types, as long as they exhibited a satisfactory binding property. The resinous binder comprises at least one member selected from, for example, polyester resins, acrylic resins, epoxy resins, polycarbonate resins, melamine-formaldehyde resins, butyral resins, silicone resins, polyurethane resins, polyamide resins, alkyd resins, polystyrene resins, polyvinyl butyral resins, xylene-formaldehyde resins, and phenoxy resins.

In the electrophotographic layer, the resinous binder is preferably in an amount of from 10% to 30%, more preferably from 15% to 25%, based on the weight of the zinc oxide.

The laser-sensitive electrophotographic material of the present invention can be produced in the following manner.

A coating paste is prepared by uniformly mixing predetermined amounts of finely divided zinc oxide, a sensitizing coloring material comprising at least one compound of the formulae (I) and (II), a sensitizing assistant comprising at least one carboxylic anhydride of the formula (III), a resinous binder and an organic medium comprising at least one member selected from, for example, toluene and ethyl acetate, by a mix-dispersing machine, for example, a ball mill, sand grinder or paint shaker.

In the mixing procedure, all components may be admixed in a single step, but preferably, in the first step, the zinc oxide particles are mixed with the sensitizing assistant to absorb the sensitizing assistant on the surface thereof, and then the remaining components are admixed therewith. In the first step, the zinc oxide particles are dispersed in a solution of the sensitizing assistant in a solvent, and the sensitizing coloring material and the resinous binder are successively admixed to the dispersion after at least a portion of the solvent is removed by evaporation, or without evaporating the solvent, to provide a coating paste.

The coating paste is applied to a surface of the electroconductive substrate and the layer of the coating paste is dried and solidified to form an electrophotographic layer.

The thickness of the electrophotographic layer influences the static build-up property, and sensitivity and resolving property thereof, and thus is preferably from 5 to 20 μm, more preferably from 10 to 15 μm.

EXAMPLES

The specific examples presented below will more fully elaborate the ways in which the present invention can be practically used. It should be understood, however, that the examples are only illustrative and in no way limit the scope of the present invention.

In the examples, the part and % are by weight unless otherwise indicated.

EXAMPLE 1

A coating paste was prepared by mixing 100 parts of finely divided photoconductive zinc oxide (available under a trademark of SAZEX2000, made by Sakai Kagaku K.K.) with 40 parts of an acrylic resinous binder (available under the trademark LR-188, made by Mitsubishi Rayon Co.), 80 parts of toluene, and 0.1 part of a sensitizing assistant consisting of maleic anhydride. The mixture was admixed with a solution of 0.03 part of a sensitizing coloring material consisting of a compound of the formula (I), wherein $m^1$ and $m^2$ respectively represented an integer of 3, $R^1$ and $R^2$ respectively represented a $—SO_3$ radical,

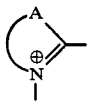

represented a radical of the formula:

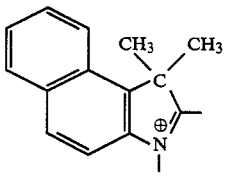

and

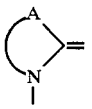

represented a radical of the formula:

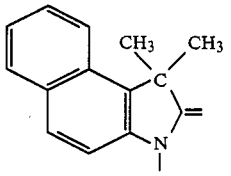

in 5 parts of methyl alcohol.

The sensitizing compound was of the formula:

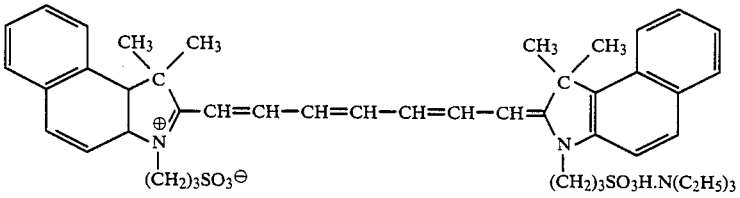

The admixture was dispersed with glass beads in a paint conditioner for 30 minutes.

An electroconductive substrate was prepared by coating a surface of a paper sheet having a weight of 100 g/m² with a resinous composition containing an electroconductivity-imparting agent consisting of polyvinyl benzyltrimethyl ammonium chloride to form an electroconductive layer on the paper sheet. Then, the electroconductive layer was coated with a solvent-resistive layer to form an electroconductive substrate.

The electroconductive surface of the substrate was coated with the above-mentioned coating paste and the coating paste layer was dried by hot air blowing at a temperature of 100° C. to provide an electrophotographic layer having a thickness of about 15 μm, and an electrophotographic sheet was obtained.

The electrophotographic layer of the electrophotographic sheet was charged with negative corona charge, a spectral light having a wave length of 780 nm was radiated onto the charged surface of the electrophotographic sheet, and the reduction in potential of the electrophotographic layer surface was measured. From the measured value of reduction in potential, a half-value of exposure $E_{\frac{1}{2}}$ of the electrophotographic layer was calculated as a sensitivity thereof. The resultant $E_{\frac{1}{2}}$ is shown in Table 1.

The electrophotographic layer was charged with a negative corona charge and the charged surface was subjected to a scanning exposure to a semiconductor laser ray having a wave length of 780 nm at 5 mW in accordance with a predetermined pattern.

The laser-exposed electrophotographic sheet was developed with a positive charged toner (made by ITEK).

Then the toner concentrations of the images formed on the laser-exposed portions and the laser-non-exposed portions of the electrophotographic layer were determined. The results are shown in Table 1. The data shown in Table 1 shows the sensitivity of the electrophotographic layer to the semiconductor laser ray.

EXAMPLE 2

The same procedures as those described in Example 1 were carried out except that the coating paste was prepared in the following manner.

A solution of 0.1 part of a sensitizing assistant consisting of maleic anhydride in 80 parts of toluene was mixed with 100 parts of an electroconductive zinc oxide (SAZEX 2000, Sakai Kagaku). The mixture was dispersed by using an ultrasonic disperser for 20 minutes. The dispersion was mixed with 40 parts of an acrylic resinous binder (LA-188, made by Mitsubishi Rayon) and then with a solution of 0.03 parts of the same sensitizing coloring material as that mentioned in Example 1 in 5 parts of methyl alcohol. The resultant mixture was dispersed with glass beads in a paint conditioner for 30 minutes.

The coating paste was applied in the same manner as mentioned in Example 1 to provide an electrophotographic sheet.

The electrophotographic sheet was subjected to the same tests as mentioned in Example 1.

The results are indicated in Table 1.

EXAMPLE 3

The same procedures as those described in Example 2 were carried out with the following exception.

The sensitizing coloring material consisted of a compound of the formula (II) in which $n^1$ and $n^2$ respectively represented an integer of 2, $R^3$ and $R^4$ respectively represented a hydrogen atom, X represented an iodine atom, represented a group of the formula:

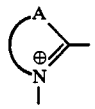

represented a group of the formula:

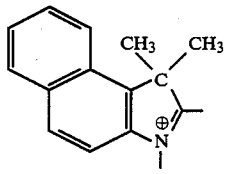

and

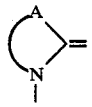

represented a group of the formula:

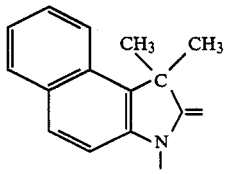

The sensitizing compound was used in an amount of 0.1 part.

The results are shown in Table 1.

EXAMPLE 4

The same procedures as those mentioned in Example 2 were carried out with the following exception.

The sensitizing coloring material consisted of a compound of the formula (II) where $n^1$ and $n^2$ respectively represented an integer of 1, $R^3$ and $R^4$ respectively represented a $—CH=CH_2$ radical, X represented a $C10_4$ radical,

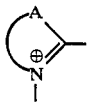

represented a group of the formula:

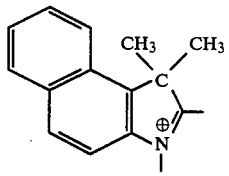

and

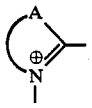

represented a group of the formula:

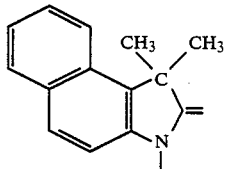

and was used in an amount of 0.1 part.

The results are shown in Table 1.

EXAMPLE 5

The same procedures as those mentioned in Example 2 were carried out with the following exception.

The sensitizing coloring material consisted of a compound of the formula (II) wherein $n^1$ and $n^2$ respectively represented an integer of 3, $R^3$ represented a $—SO_3H$ radical, $R^4$ represented a $—SO_3Na$ radical, X represented an iodine atom,

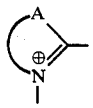

represented a group of the formula:

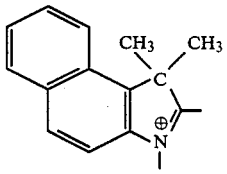

and

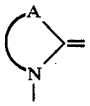

represented a group of the formula:

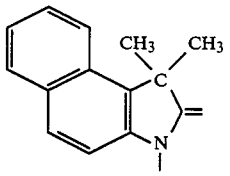

and was used in an amount of 0.1 part.

The results are indicated in Table 1.

EXAMPLE 6

The same procedures as those described in Example 2 were carried out with the following exception.

The sensitizing coloring material consisted of a compound of the formula (II) wherein $n^1$ and $n^2$ respectively represented an integer of 1, $R^3$ and $R^4$ respectively represented a $—CH{=}CH_2$ radical, X represented a $C10_4$ radical,

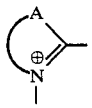

represented a group of the formula:

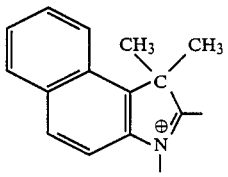

and

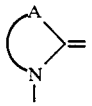

represented a group of the formula:

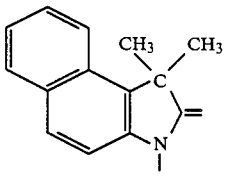

and was used in an amount of 0.1 part.

EXAMPLE 7

The same procedures as in Example 2 were carried out with the following exception.

The sensitizing coloring material consisted of a compound of the formula (I) wherein $m^1$ and $m^2$ respectively represented an integer of 3, $R^1$ represented a $—SO_3$ radical, $R^2$ represented a $—SO_3$ radiant, represented a group of the formula:

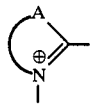

represented a group of the formula:

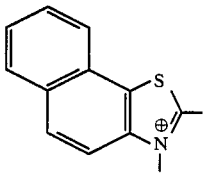

and

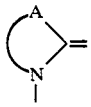

represented a group of the formula:

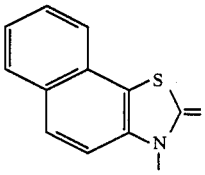

and was used in an amount of 0.1 part.

The results are indicated in Table 1.

COMPARATIVE EXAMPLE 1

The same procedures as in Example 1 were carried out except that no sensitizing assistant was used.

The results are shown in Table 1.

COMPARATIVE EXAMPLE 2

The same procedures as in Example 2 were carried out except that a comparative sensitizing assistant consisting of phthalic anhydride was used in an amount of 0.1 part.

The results are shown in Table 1.

COMPARATIVE EXAMPLE 3

The same procedures as in Example 3 were carried out except that a comparative sensitizing assistant consisting of phthalic anhydride was used in an amount of 0.1 part.

The results are shown in Table 1.

COMPARATIVE EXAMPLE 4

The same procedures as in Example 4 were carried out except that a comparative sensitizing assistant consisting of chloranyl was used in an amount of 0.1 part.

The results are shown in Table 1.

COMPARATIVE EXAMPLE 5

The same procedures as in Example 5 were carried out except that a comparative sensitizing assistant consisting of chloranyl was used in an amount of 0.1 part.

The results are shown in Table 1.

COMPARATIVE EXAMPLE 6

The same procedures as in Example 6 were conducted except that a comparative sensitizing assistant consisting of dinitrobenzoic acid was used in an amount of 0.1 part.

The results are indicated in Table 1.

COMPARATIVE EXAMPLE 7

The same procedures as in Example 7 were conducted except that a comparative sensitizing assistant consisting of dinitrobenzoic acid was used in an amount of 0.1 part.

The results are shown in Table 1.

TABLE 1

| Example No. | Item: Sensitivity ($E_{\frac{1}{2}}$ erg/cm$^2$) | Toner concentration: Non-exposed portion | Toner concentration: Exposed portion |
|---|---|---|---|
| Example 1 | 56 | 0.92 | 0.13 |
| Example 2 | 46 | 0.90 | 0.11 |
| Example 3 | 72 | 0.87 | 0.16 |
| Example 4 | 80 | 0.87 | 0.18 |
| Example 5 | 58 | 0.88 | 0.13 |
| Example 6 | 62 | 0.90 | 0.14 |
| Example 7 | 70 | 0.88 | 0.15 |
| Comparative Example 1 | 180 | 0.93 | 0.35 |
| Comparative Example 2 | 134 | 0.87 | 0.27 |
| Comparative Example 3 | 156 | 0.85 | 0.30 |
| Comparative Example 4 | 166 | 0.88 | 0.32 |
| Comparative Example 5 | 150 | 0.90 | 0.2 |
| Comparative Example 6 | 140 | 0.80 | 0.26 |
| Comparative Example 7 | 141 | 0.78 | 0.27 |

As clearly shown by Table 1, the electrophotographic layers of Examples 1 to 7 exhibited a higher sensitivity to the semiconductor laser ray having a wave length of 700 nm than that of Comparative Examples 1 to 7.

Namely, in the laser ray-non-exposed portions, the toner concentrations of Examples 1 to 7 were similar to those of Comparative Example 1 to 7, but in the laser ray-exposed portions, the toner concentrations of Examples 1 to 7 were smaller than those of Comparative Example 1 to 7.

This phenomenon indicates that the specific sensitizing assistant of the present invention is very effective for enhancing the sensitivity of the electrophotographic layer to the laser rays. This enhancement of the laser-sensitivity was attained for the first time by the present invention.

In the prior arts, it is believed that a scanning exposure by the semiconductor laser rays at a high speed is very difficult in practical use, but the electrophotographic material of the present invention exhibits a significantly promoted sensitivity to the laser rays, especially semiconductor laser rays, due to the specific combination of the sensitizing coloring compound of the formula (I) or (II) with the sensitizing assistant compound of the formula (III). Namely, the electrophotographic material of the present invention allows, for the first time, a practically utilization of a high speed scanning exposure by semiconductor laser rays.

We claim:

1. A laser-sensitive electrophotographic material comprising (A) an electroconductive substrate; and (B) a laser-sensitive electrophotographic layer formed on a surface of the substrate and comprising a finely divided photoconductive zinc oxide, a resinous binder, a sensitizing coloring material and a sensitizing assistant, said sensitizing coloring material comprising at least one member selected from the group consisting of the compounds of the formulae (I) and (II):

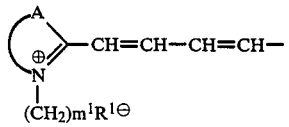

(I)

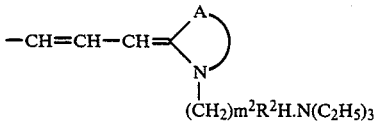

and

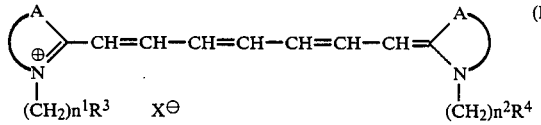

(II)

in which formulae $m^1$ and $m^2$ represent respectively and independently from each other, an integer of 1 to 8, $R^1$ and $R^2$ represent respectively, and independently from each other, a member selected from the group consisting of —COO and —$SO_3$ radicals, $n^1$ and $n^2$ represent respectively, and independently from each other, an integer of 1 to 8, $R^3$ and $R^4$ represent respectively, and independently from each other, a member selected from the group consisting of a hydrogen atom and —CH=$CH_2$ , —COOH, —$SO_3H$, —COONa, —$SO_3Na$, —COOK and —$SO_3K$ radicals, X represents a member selected from the group consisting of chroline, bromine and iodine atoms and —$C10_4$ radical, the terminal group of the formula

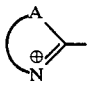

is selected from the group consisting of and the terminal group of the formula

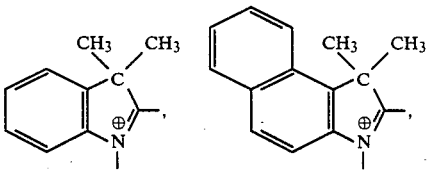

-continued

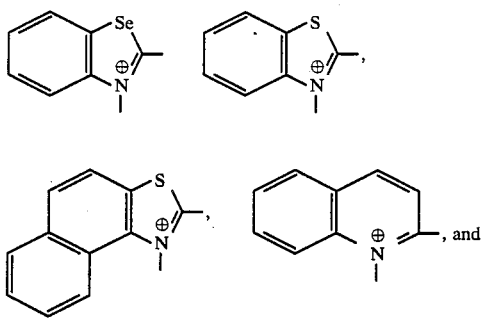

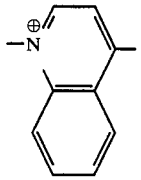

and the terminal group of the formula

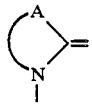

is selected from the group consisting of

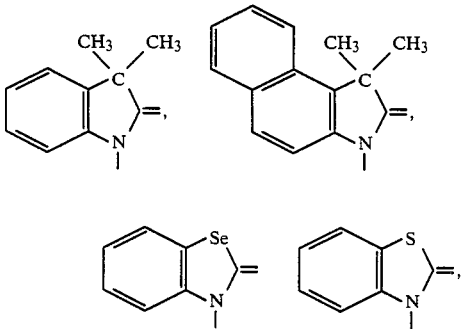

-continued

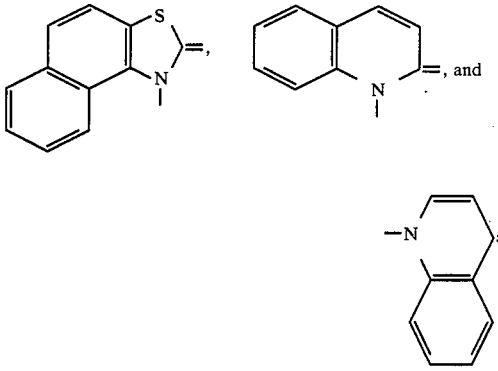

and the sensitizing assistant comprising at least one carboxylic acid anhydride of the formula (III):

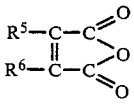

(III)

wherein $R^5$ and $R^6$ represent respectively, and independently from each other, a member selected from the group consisting of a hydrogen atom and substituted and unsubstituted alkyl radicals having 1 to 8 carbon atoms and phenyl radical.

2. The electrophotographic material as claimed in claim 1, wherein the sensitizing coloring material in the electrophotographic layer is in an amount of 0.001% to 0.5% based on the weight of the zinc oxide.

3. The electrophotographic material as claimed in claim 1, wherein the sensitizing assistant in the electrophotographic layer is in an amount of 0.01% to 1% based on the weight of the zinc oxide.

4. The electrophotographic material as claimed in claim 1, wherein the resinous binder in the electrophotographic layer is in a dry solid amount of 10% to 30% based on the weight of the zinc oxide.

5. The electrophotographic material as claimed in claim 1, wherein the electrophotographic layer has a thickness of from 5 to 20 μm.

6. The electrophotographic material as claimed in claim 1, wherein the sensitizing coloring material in the electrophotographic layer comprises at least one compound of the formula:

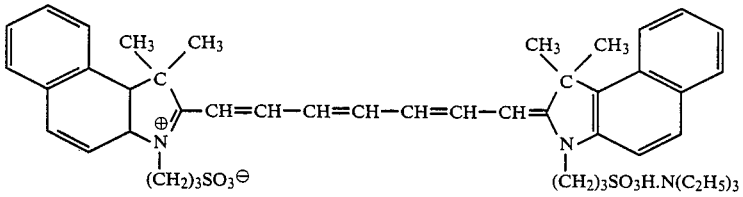

7. The electrophotographic material as claimed in claim 1, wherein the sensitizing assistant in the electrophotographic layer comprises maleic anhydride.

* * * * *